United States Patent [19]

Mattress, Jr.

[11] Patent Number: 4,531,770

[45] Date of Patent: Jul. 30, 1985

[54] METER RING

[75] Inventor: Albert Mattress, Jr., Spencer, Mass.

[73] Assignees: Norman S. Blodgett; Gerry A. Blodgett, both of Worcester, Mass.

[21] Appl. No.: 459,309

[22] Filed: Jan. 20, 1983

Related U.S. Application Data

[63] Continuation of Ser. No. 236,987, Feb. 20, 1981, abandoned, which is a continuation of Ser. No. 945,199, Sep. 25, 1978.

[51] Int. Cl.[3] ..... B65D 33/34

[52] U.S. Cl. ..... 292/307 R

[58] Field of Search ..... 292/307, 317–324

[56] References Cited

U.S. PATENT DOCUMENTS

| | | | |
|---|---|---|---|
| 712,250 | 10/1902 | Brooks | 292/318 |
| 1,519,671 | 12/1924 | Dietye | 292/323 |
| 1,665,424 | 4/1928 | Strohm | 292/323 X |
| 1,676,014 | 7/1928 | Fecher | 292/318 |
| 4,149,741 | 4/1979 | Lipscomb et al. | 292/322 X |

FOREIGN PATENT DOCUMENTS

| | | | |
|---|---|---|---|
| 575229 | 2/1946 | United Kingdom | 292/317 |

*Primary Examiner*—Richard E. Moore

*Attorney, Agent, or Firm*—Blodgett & Blodgett

[57] ABSTRACT

Meter ring for one-time use, consisting of a band having locking means at its free ends and a tear strip at an intermediate portion.

14 Claims, 9 Drawing Figures

METER RING

This is a continuation of application Ser. No. 236,987, filed Feb. 20, 1981, now abandoned, which is a continuation of application Ser. No. 945,199, filed Sept. 25, 1978.

BACKGROUND OF THE INVENTION

It is the usual practice in the installation of an electric meter at the point of use to provide a box into which extend the incoming and out-going electrical cables and to apply to the face of this box the meter for reading the amount of consumption. The box is provided with an annular flange and the meter is provided with a similar flange, the two flanges being held together by a nut and bolt which allows the band to be clamped tightly around the flanges and hold the meter firmly in place. In recent years, however, it has been necessary to lock the band in place, so that it could not be removed. This has come about, because of the fact that many unauthorized persons have been entering the meter box and "bypassing" the meter, thus using electricity without it being recorded in the meter. Also, there has been some vandalism that takes the form of removing the meter and damaging it. Also, an important problem is encountered because of the fact that some customers remove the meter and replace it in inverted condition so that the meter operates in reverse and gives a low reading. In addition, there have been those who actually steal the meter itself for their own purposes. In order to counteract these tendencies, it has been necessary to provide a lock to hold the ends of the band together to prevent removal of the meter from the box. At one time it was only necessary to provide a lock having a seal, so that it would be evident that the lock has been tampered with, but it has been found that a simple seal is often not sufficient to discourage those who wish to gain entry to the meter and the meter box. One of the problems that has been encountered in attempting to design a practical lock for this purpose has been the fact that, if an edge of the band is available and accessible, it is possible to cut the band with a pair of strong tin snips or aircraft shears. Furthermore, while many ingenious locks have been conceived for this purpose, most of them are quite expensive and, because of a complexity of their mechanism, they have been relatively difficult to install or remove even by the legitimate meter technician. After all, part of the problem is the fact that, even though the would-be thief is not able to dismantle the lock and the band, nevertheless he can do so much damage to the lock that is difficult for the legitimate electrical installer to later obtain access to the meter. These and other difficulties experienced with the prior art devices have been obviated in a novel manner by the present invention.

It is, therefore, an outstanding object of the invention to provide a meter lock which is relatively easy for an authorized person to install or remove.

Another object of this invention is the provision of a meter lock which is simple in construction and which can withstand a considerable amount of abuse without being rendered inoperative.

It is another object of the instant invention to provide a meter lock which is inexpensive to manufacture and which is capable of a long life of useful service with a minimum of maintenance.

It is a still further object of the invention to provide a meter lock which shows the presence of tampering.

It is a still further object of the present invention to provide a meter lock which, from the nature of its design, is capable if being constructed of a small number of very strong, simple, and rugged parts.

Another object of this invention is the provision of a meter lock consisting of a small number of readily-replaceable elements.

With these and other objects in view, as will be apparent to those skilled in the art, the invention resides in the combination of parts set forth in the specification and covered by the claims appended hereto.

SUMMARY OF THE INVENTION

In general, the invention consists of a meter ring having a band in the form of a loop adapted to embrace an annular meter flange. The housing is permanently attached to one end of the band, the housing being formed with an inner chamber having a passage leading into it. The other end of the band is formed with an apertured tongue which is adapted to extend into the passage. A locking member resides in the chamber and has a finger extending laterally for engagement with the aperture in the tongue. The locking member includes a resilient means for biasing the finger laterally and preventing retraction of the finger from the aperture.

More specifically, the band is in the form of a channel with legs that extend inwardly of the loop. This locking member is in the form of a resilient metal clip having two plate-like legs in spaced, parallel relationship and joined at one end by a bight and providing an opening at the other end to lie adjacent the passage in the housing to receive the tongue between them. The bight of the locking member acts as the resilient means to bias the legs toward one another to embrace the tongue.

Each of the legs is provided with a series of integral fingers inclined away from the passage entering the housing and adapted to slide along the surface of the tongue as it passes between the legs. The band is formed of a thin sheet metal and includes in an intermediate portion a tear tab with a grasping finger for bringing about a tearing of the tab and a separation of the loop.

DESCRIPTION OF THE DRAWINGS

The character of the invention, however, may be best understood by reference to one of its structural forms, as illustrated by the accompanying drawings, in which.

Figure 1:
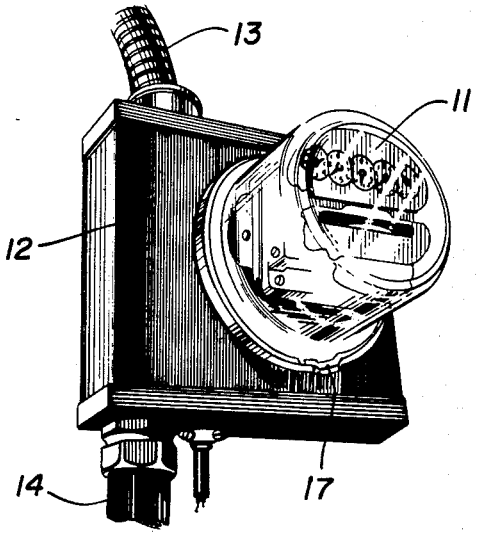
FIG. 1 is a perspective view of the meter ring embodying the principles of the present invention and shown in view with a meter.
Figure 2:
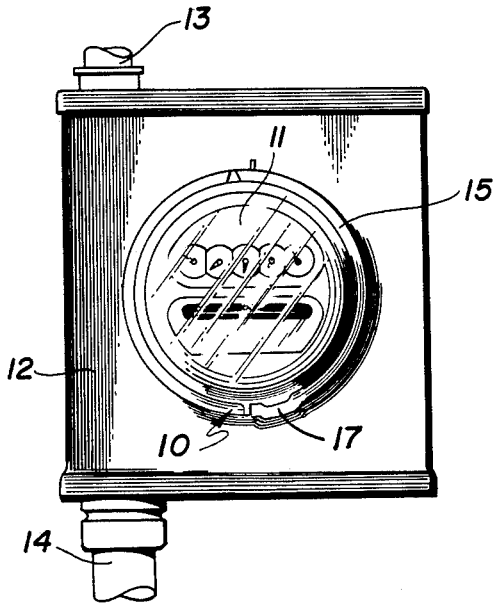
FIG. 2 is a front elevational view of the ring and meter.
Figure 3:
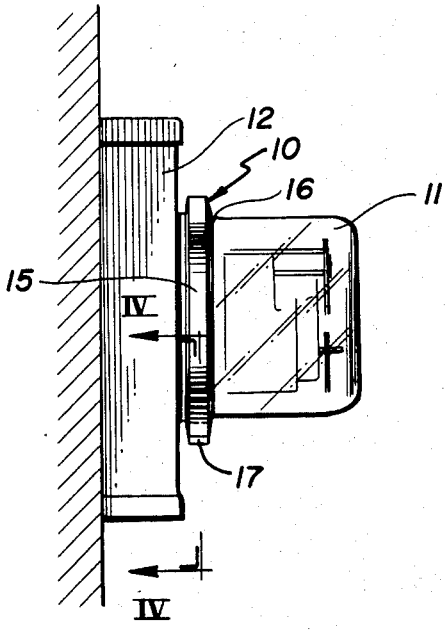
FIG. 3 is a side elevational view of the ring and meter.

Referring first to FIGS. 1, 2, and 3, wherein are best shown the general features of the invention, the meter ring, indicated generally by the reference numeral 10, is shown in use with a conventional meter 11, and the usual meter box 12. The meter box is mounted on the side of a building and an inlet cable 13 leads down from the weatherhead and enters the upper part of the box. An outlet cable 14 leads from the lower part of the box to the main switch in the interior of the building and to the fuse box serving the building.

The meter 11 generally consists of a clear glass or plastic housing having an annular flange 16 which lies against and is connected to a similar flange on the meter box 12. The meter lock includes a band 15 of U-shaped cross-section which embraces the two flanges and holds them tightly together, one end of the band enters a housing 17 formed on the other end of the band.

Figure 4:
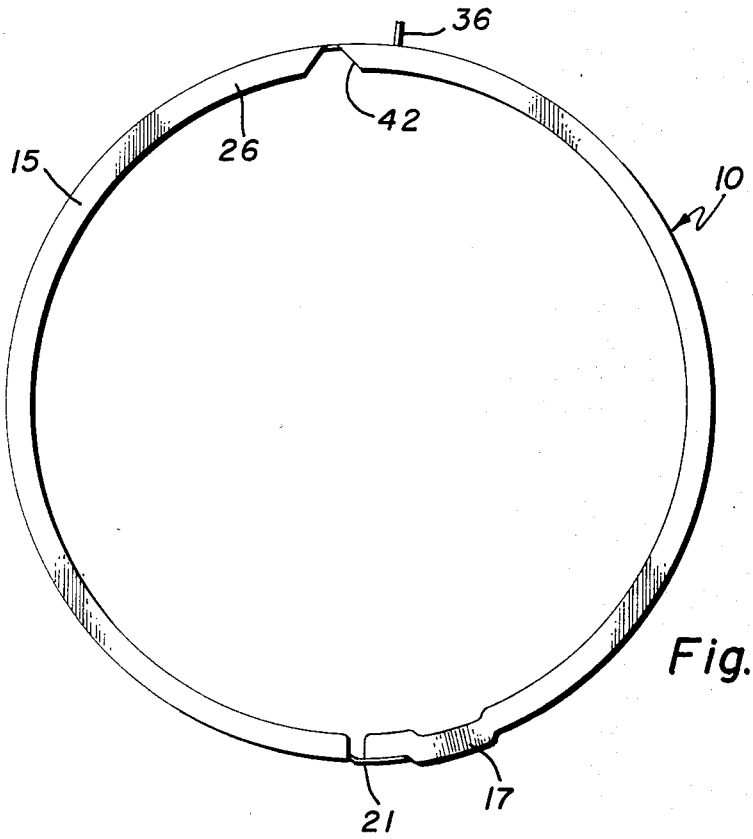
FIG. 4 is a front elevational view on a larger scale of the ring.

FIG. 4 shows the general features of the meter lock 10 and, particularly, the manner in which one end of the band 15 is provided with a tongue 21 which extends into the housing 17 formed on the other end. In the intermediate portion, one leg 26 of the band is provided with a notch 42 and the other leg is similarly notched. The finger 36 associated with a tear tab portion of the band is located adjacent the notches.

Figure 5:
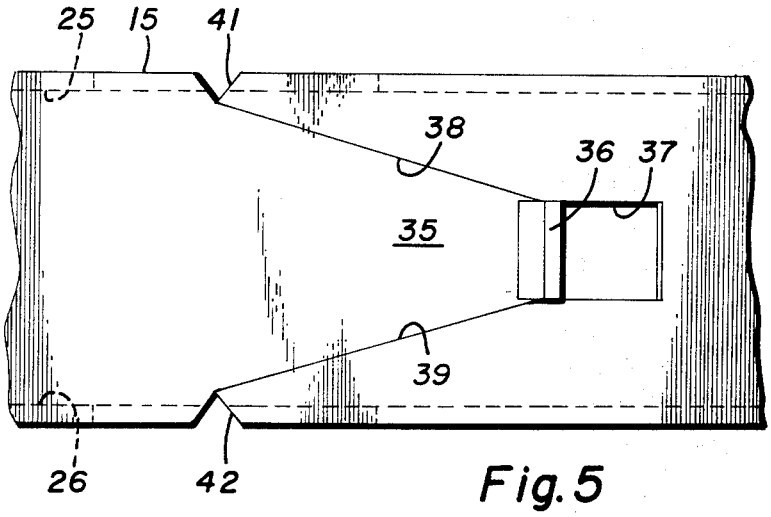
FIG. 5 is a top plan view of a portion of the ring.
Figure 6:
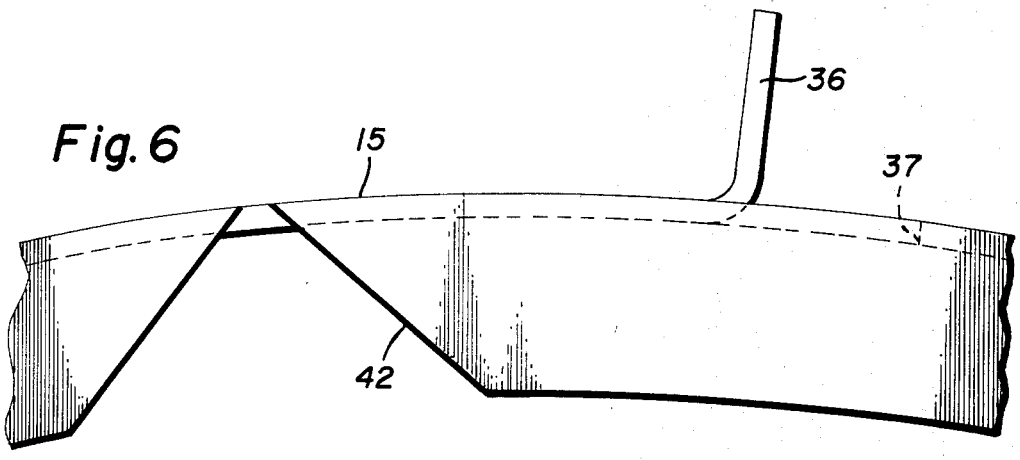
FIG. 6 is an elevational view of the top part of the ring.

FIGS. 5 and 6 show the manner in which the band 15 is formed of thin sheet metal and includes, at an immediate portion, a weakened tear tab 35 with the grasping finger 36 for bringing about a tearing of the tab and a separation of the loop. The tear tab includes a centrally-located aperture 37 formed in the web of the band and two weakened tear lines 38 and 39 extending at an angle to each other. These lines extend from the aperture to the notches 41 and 42, respectively, formed on the legs 25 and 26 of the band. The grasping finger 36 is integral with the band material between the tear lines and extends radially outwardly of the loop.

Figure 8:
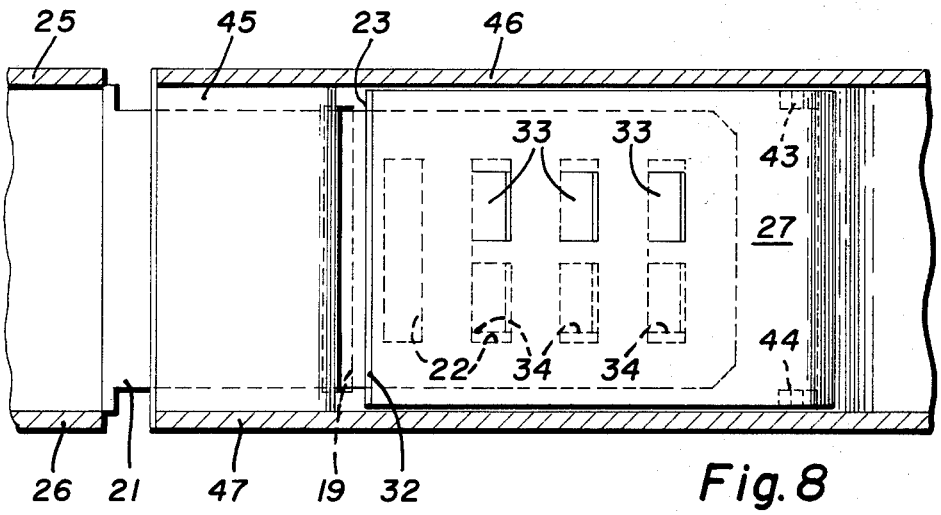
FIG. 8 is a generally horizontal sectional view of the ring taken on the line VIII—VIII of FIG. 7.
Figure 9:
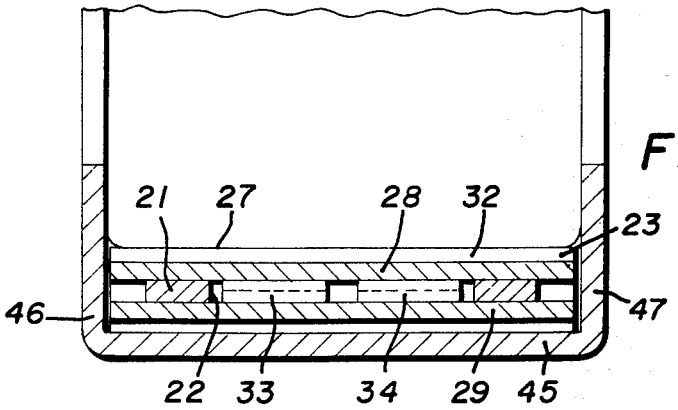
FIG. 9 is a vertical sectional view of the lower part of the ring taken on the line IX—IX of FIG. 7.
Figure 7:
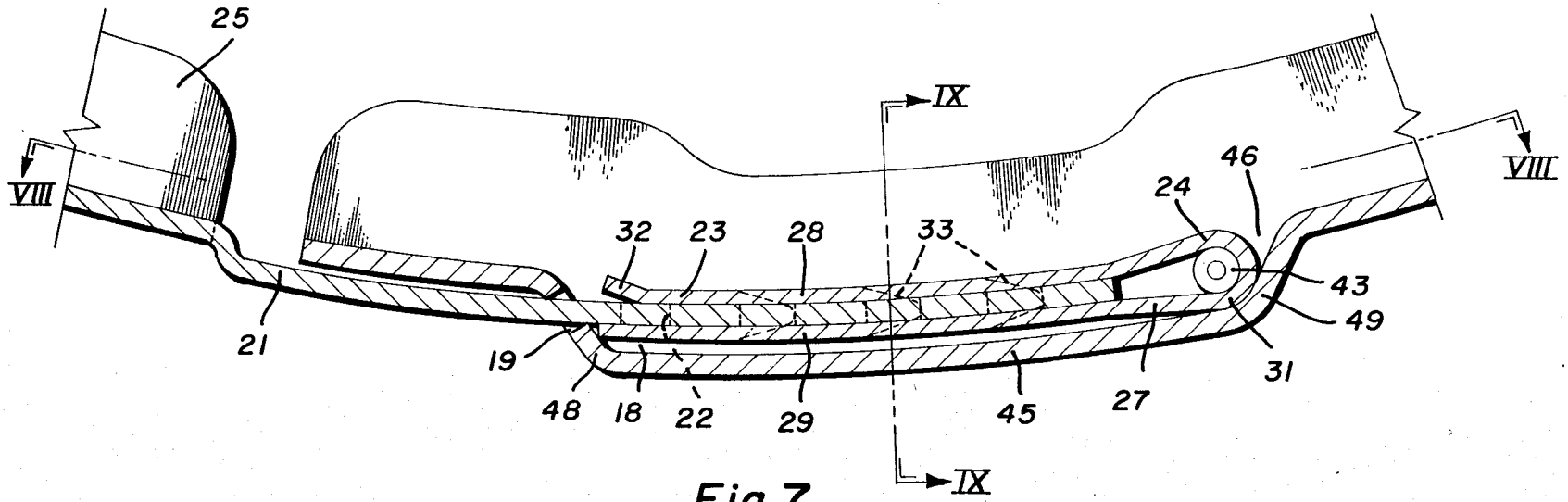
FIG. 7 is a vertical sectional view of the bottom part of the ring.

FIGS. 7, 8, and 9 shows that the housing 17 is integrally formed in the end of the band 15. The housing is formed with an inner chamber 18 (FIG. 7) having a passage 19 leading into it. The tongue 21 is provided with apertures 22 and extends through the passage 19 into the chamber 18. A locking member 23 resides in the chamber 18 and has a series of fingers 33 extending laterally for engagement with the apertures 22 in the tongue. The locking member 23 includes resilient means 24 for biasing the fingers 33 toward the tongue to prevent retraction of the finger from the aperture.

As has been stated, the band has a U-shaped cross-section with legs 25 and 26 directed inwardly of the loop. The locking member 23 is in the form of a resilient metal clip 27 having two plate-like legs 28 and 29 which lie in spaced, parallel relationship and are joined at one end by a bight 31. This provides an opening at the other end lying adjacent the passage 19 in the housing to receive the tongue 21 between them. The bight of the locking members acts as the resilient means 24 to bias the legs toward one another to embrace the tongue. One of the legs is formed with a lip 32 extending away from the other leg to assist entry of the tongue between the legs. Each of the legs 28 and 29 is provided with a series of integral fingers 33 and 34, respectively, which are inclined away from the passage entering the housing and are adapted to slide along the surface of the tongue as it passes between the legs, one of the fingers entering and residing in the apertures in the tongue. The housing 17 is provided with opposed integral pins 43 and 44 which lie in the bight 31 of the locking member to locate it in the housing and to give it a limited pivotal action. The housing 17 is formed with a bottom wall 45, two side walls 46 and 47, an end wall 48 which carries the passage 19, and another end wall 49 which is adjacent the pins 43 and 44.

The operation and advantages of the present invention will now be readily understood in view of the above description. When it is desired to assemble the meter and the meter box, a power company employee places the flange 16 of the meter 11 against the corresponding flange on the front face of the meter box 12. This, of course, is done after all the wiring associated with the cable 13 and 14 has been completed. With the two flanges in juxtaposition, the band 15 is placed around the flanges with the end carrying the housing 17 located in the lower position. The band is tightened around the flanges and the tongue 21 is introduced into the passage 19 and into the interior chamber 18 of the housing 17. The tongue almost immediately enters the passage between the two legs 28 and 29 of the locking member 23 assisted by the lip 32. As the leading end of the tongue engages and cams along each of the pairs of fingers 33 and 34, it forces the plates apart against the resilient resistance of the bight 31. When the band has been completely tightened, the fingers 33 and 34 will remain in the apertures 22 in which they have fallen. It is then impossible to reverse the process without destroying the meter ring and rendering it no longer useful. If a vandal or thief wishes to gain access to the meter, he cannot do so without destroying the band and making his access evident. If an electric company employee desires to open the meter ring to remove the meter, etc., it is only necessary for him to grasp the finger 36 with a pair of pliers and pull it in the direction of the lines 38 and 39. The material will tear, since the lines 38 and 39 have been weakened, usually by scoring. The ring is, therefore, totally destroyed and incapable of being reassembled. Obviously, any tampering with the meter will be evident and suitable action can be taken.

It can be seen, then, that the present device is not only simple and rugged, but it consists of a few simple parts which are easily replaced if damaged. The band is inexpensive and expandable, so that it is economically feasible to throw it away after it has been removed from the meter and a new ring substituted in its place.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Meter ring, comprising:

(a) a band in the form of a thin sheet metal loop adapted to embrace an annular meter flange, said band having an intermediate portion provided with a weakened tear tab with a gripping finger for bringing about a tearing of the tab and a separation of the loop, (b) a housing permanently attached to one end of the band, the housing being formed with an inner chamber and with a passage leading into it, the other end of the band being formed with an apertured tongue adapted to extend into the passage, and (c) a locking member residing in the chamber and having a finger extending laterally for engagement with the aperture in the tongue, the locking member including resilient means biasing the finger toward the tongue and preventing retraction of the finger from the aperture.

2. Meter ring as recited in claim 1, wherein the tear tab includes a centrally-located aperture in the band and two weakened tear lines extending at an angle to each other and leading from the aperture to the edge of the band, the grasping finger being integral with the band material between the tear lines and extending generally outwardly of the band.

3. Meter ring as recited in claim 2, wherein the locking member is in the form of a resilient metal clip having two plate-like legs in spaced, parallel relationship and joined at one end by a bight and providing an opening at the other end to lie adjacent the passage in the housing to receive the tongue between them.

4. Meter ring as recited in claim 3, wherein the bight of the locking member acts as the resilient means to bias the legs toward one another to embrace the tongue.

5. Meter ring as recited in claim 4, wherein one of the legs is formed with a lip extending away from the other leg to assist entry of the tongue between the legs.

6. Meter ring as recited in claim 4, wherein each of the legs is provided with a series of integral fingers inclined away from the passage entering the housing and adapted to slide along the surface of the tongue as it passes between the legs, one of the fingers entering and residing in the aperture in the tongue.

7. Meter ring as recited in claim 4, wherein the housing has integral pins lying in the bight of the locking member to locate it in the housing and to give it a limited pivotal action.

8. Meter ring as recited in claim 7, wherein the housing has a bottom wall, two side walls, and two end walls, the passage being formed in one of the end walls, the integral pins being formed from the side walls at a position adjacent the other end wall.

9. Meter ring comprising:

(a) a band in the form of a loop adapted to embrace an annular meter flange, (b) a housing permanently attached to one end of the band, the housing being formed with an inner chamber and with a passage leading into it, the other end of the band being formed with an aperture tongue adapted to extend into the passage, and (c) a locking member residing in the chamber and comprising a metal clip having two plate-like legs in spaced, parallel relationship, and joined at one end by a resilient bight which biases the legs toward one another, said legs providing an opening at the other end to lie adjacent the passage in the housing to receive the tongue between them, at least one of said legs having a relatively rigid finger extending at an angle toward the other leg and away from said opening for engagement with the aperture in the tongue to allow insertion of said tongue between said legs and to prevent retraction of the tongues from between said legs, the housing having integral pins lying in the bight of the locking member to locate it in the housing and to give it a limited pivotal action.

10. Meter ring as recited in claim 9, wherein one of the legs is formed with a lip extending away from the other leg to assist entry of the tongue between the legs.

11. Meter rings as recited in claim 9, wherein each of the legs is provided with a series of integral fingers inclined away from the passage entering the housing.

12. Meter ring as recited in claim 9, wherein the housing has a bottom wall, two side walls, and two end walls, the passage being formed in one of the end walls, the integral pins being formed from the side walls at a position adjacent the other end wall.

13. Meter ring comprising:

(a) a band in the form of a loop adapted to embrace an annular meter flange, (b) a housing permanently attached to one end of the band, the housing being formed with an inner chamber and with a passage leading into it, the other end of the band being formed with a tongue having laterally extending notches and adapted to extend into the passage, and (c) a locking member residing in the chamber and comprising a metal clip having two plate-like legs in parallel relationship, and joined at one end by a resilient bight which is anchored in the housing and which biases the legs toward one another and in engagement with one another, at least one of said legs having a lip at the other end which extends away from the other leg to form an opening adjacent the passage in the housing to receive the tongue between them, at least one of said legs having a relatively rigid finger extending at an acute angle toward said bight to allow insertion of said tongue between said legs, and to engage one of said notches to prevent retraction of the tongue from between said legs, to lock the tongue, the clip and the housing together.

14. Meter ring as recited in claim 1, wherein the band has a U-shaped cross-section with the legs directed inwardly of the loop.

* * * * *